United States Patent [19]

Binder

[11] Patent Number: 4,729,346

[45] Date of Patent: Mar. 8, 1988

[54] AIR-COOLED MULTI-CYLINDER INTERNAL COMBUSTION ENGINE

[75] Inventor: Robert Binder, Schwieberdingen, Fed. Rep. of Germany

[73] Assignee: Dr. Ing. h.c.F. Porsche Aktiengesellschaft, Stuttgart, Fed. Rep. of Germany

[21] Appl. No.: 49,828

[22] Filed: May 15, 1987

[30] Foreign Application Priority Data

May 16, 1986 [DE] Fed. Rep. of Germany ..... 3616635

[51] Int. Cl.[4] ..... F01B 1/02

[52] U.S. Cl. ..... 123/41.61; 123/41.69

[58] Field of Search ..... 123/41.50, 41.62, 41.69, 123/41.7

[56] References Cited

U.S. PATENT DOCUMENTS 2,184,345 12/1939 Hersey ..... 123/41.6
2,253,025 8/1941 Fedden et al. ..... 123/41.69
2,729,201 1/1956 Rohm ..... 123/41.6

FOREIGN PATENT DOCUMENTS 1205772 3/1960 Fed. Rep. of Germany .

*Primary Examiner*—William A. Cuchlinski, Jr.
*Attorney, Agent, or Firm*—Barnes & Thornburg

[57] ABSTRACT

Air air-cooled multi-cylinder internal combustion engine with a cylinder row through which cooling air flows transversely to the cylinders. Two guide ribs are cast-on at the cooling air discharge side of each cylinder at a distance to one another which are constructed as thin-walled profiles and are angularly bent through about 90° in mutually opposite directions.

11 Claims, 2 Drawing Figures

II
II
2
2'
3
3'
4
7
8
8
9
9
10
11
12
12
13
13

AIR-COOLED MULTI-CYLINDER INTERNAL COMBUSTION ENGINE

BACKCROUND AND SUMMARY OF THE INVENTION

The present invention relates to an air-cooled multi-cylinder internal combustion engine with individually cast cylinders arranged between the associated cylinder heads and the crankcase, which are provided externally with cooling ribs extending about the same transversely to the cylinder longitudinal axis and through which cooling air flows in the transverse direction.

Such an internal combustion engine is disclosed in DE-AS 12 05 772. The cooling air inflowing transversely to the cylinders flows along the wide side of the cooling ribs and is deflected by guide ribs. Four columns serve as guide ribs which are cast-on externally at a respective cylinder between an upper retention flange and a lower support surface to the crankcase. These columns have principally the task to reinforce the cylinders and to improve the clamping force distribution at the cylinder. However, as a result of their configuration and aerodynamic construction, they are suitable also at the same time as guide device for the cooling air and assure for an improved cylinder cooling. It is thereby disadvantageous with this prior art arrangement that the columns produce a considerable additional weight which cannot be accepted in particular with sports engines, in which one makes every effort by the selection of new material combinations and a carefully thought-through constructive design to reduce the weight. Furthermore, these high-mass columns effect an unequal radial expansion of the cylinder during temperature changes of the cylinders as they always occur during the operation of the internal combustion engine, and render the cylinder non-true, i.e., non-circular.

The object of the present invention resides in providing an internal combustion engine with a cooling air guide arrangement at the cylinders which can be manufactured in a simple manner and without siginificant weight increase and material accumulation at the cylinders.

The underlying problems are solved aocording to the present invention in that the guide ribs are constructed as thin-walled profiles which are angularly bent, respectively, bent in mutually opposite directions. If guide ribs are cast-on as guide arrangement exclusively at the cooling-air discharge side of the cylinders and if the guide ribs are constructed as thin-walled angular profiles, only a very small additional weight results therefrom. The one legs of these mutually oppositely directed, angularly bent guide ribs coincide with the guide ribs of the adjacent cylinder so that an altogether U-shaped guide rib will result while leaving free a gap disposed centrally between the cylinders.

According to a preferred embodiment of the present invention in which two adjacent guide ribs of two adjacent cylinders form together a U-shape with a gap extending centrally between the cylinders, these gaps are filled out by elastic sealing elements of synthetic resinous material or other suitable material which are fastened by snap-in action into the gaps and, in addition to their sealing function, also serve the purpose of dampinq body sound vibrations. Thus, riveted-on or screwed-on deflection or baffle plates as are disclosed in the U.S. Pat. No. 2,729,201 which are costly in assembly and represent an additional noise source, can be dispensed with.

According to another feature of the present invention, the elastic molded member is constructed as arrow-shaped deflection element for the cooling air flowing centrally between the cylinders. As the cylinders are threadably secured at an upper retention flange with the associated cylinder heads and protrude with their lower ends freely into the crankcase, they are not subjected to any stresses, therefore also need not be reinforced by columns and can expand into the crankcase during temperature-conditioned length changes.

BRIEF DESCRIPTION OF THE DRAWINGS

These and other objects, features and advantages of the present invention will become more apparent from the following description when taken in connection with the accompanying drawing which shows, for purposes of illustration only, one embodiment in accordance with the present invention, and wherein.

DETAILED DESCRIPTION OF THE DRAWINGS

Figure 1:
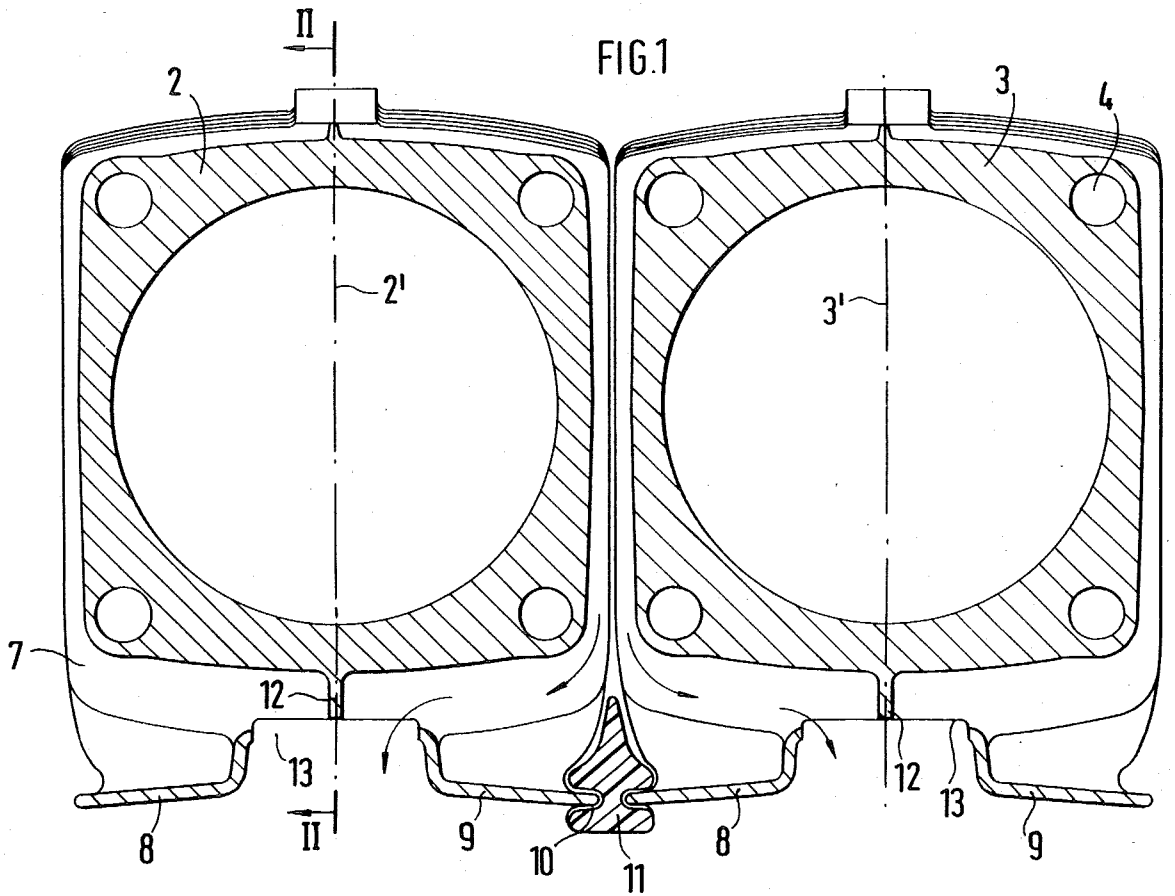
FIG. 1 is a cross-sectional view through two cylinders of an internal combustion engine in accordance with the present invention.
Figure 2:
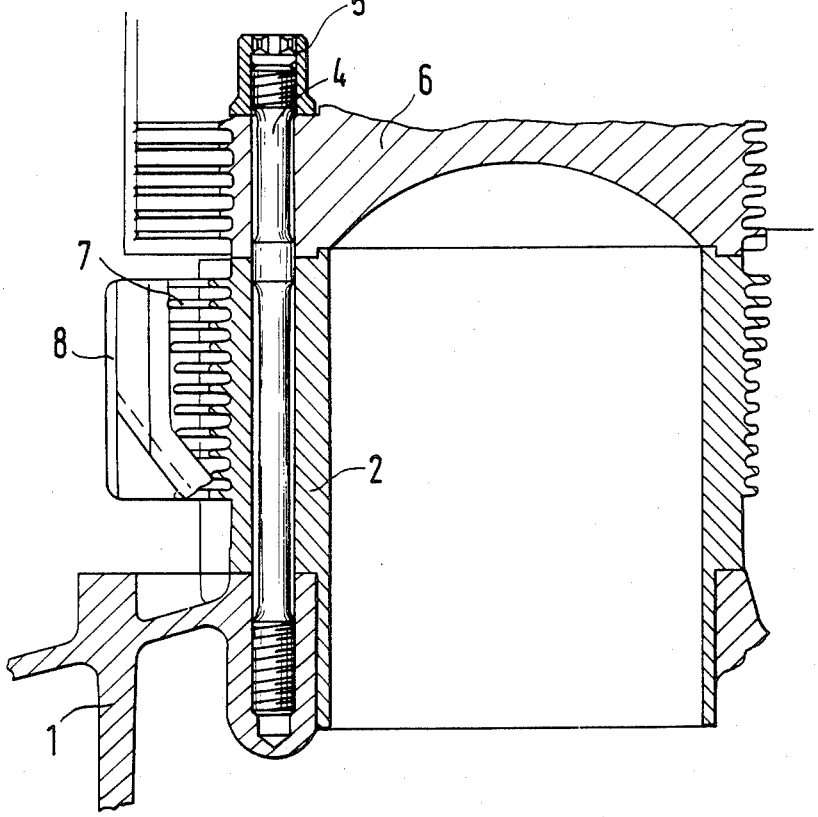
FIG. 2 is a longitudinal cross-sectional view through a cylinder taken along line II—II of FIG. 1.

Referring now to the drawing wherein like reference numerals are used throughout the two views to designate like parts, two individually cast cylinders 2 and 3 are arranged in a row adjacent one another, i.e., in-line within a crankcase 1 of an internal combustion engine and are threadably secured with the crankcase together with the cylinder heads 6 mounted on the cylinders 2 and 3 by means of expansion bolts 4 as well as nuts 5. The cylinders 2 and 3 are provided externally about their circumference with ribs 7 extending transversely to the longitudinal axis, between which the cooling air is blown through. Two guide ribs 8 and 9 each are attached at the cooling-air discharge side of the two cylinders 2 and 3 at a distance to one another which are cast-on onto three or four ribs 7. The guide ribs 8 and 9 are constructed as thin-walled profiles and are angularly bent through 90° in mutually opposite directions. The two guide ribs 9 and 8 of the adjacent cylinders 2 and 3 form together a U-shape with a gap 10 extending centrally between the cylinders. An elastic molded element 11 is fastened in the gap 10 by snap-in action which is constructed as arrow-shaped deflection element, seals the gap 10 over its entire length and at the same time serves the purpose of noise damping. The guide ribs 8 and 9 extend over the largest part of the height of the cylinders 2 and 3. They are located symmetrically to the separating ribs 12 on both sides thereof which are cast-on to project radially in the center planes 2' and 3' of the cylinders 2 and 3 while air discharge openings 13 which remain free between the guide ribs 8 and 9 of the two cylinders 2 and 3, are located concentric to the separating ribs 12.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. An air-cooled multi-cylinder internal combustion engine, comprising individually cast cylinder means arranged between associated cylinder heads and a crankcase, said cylinder means being provided externally with cooling ribs extending about the same transversely to the cylinder longitudinal axis, cooling air flowing through the cooling ribs in a transverse direction, and two guide rib means cast-on at a distance to one another at the cooling air discharge side of each cylinder, the guide rib means being constructed as thin-walled profiles which are angularly bent in mutually opposite directions.

2. An internal combustion engine according to claim 1, wherein adjacent guide rib means of two cylinder means disposed adjacent one another form together a substantially U-shape with a gap extending centrally between the cylinder means.

3. An internal combustion engine according to claim 2, further comprising an elastic member fastened in the gap which seals the gap over its entire length.

4. An internal combustion engine according to claim 3, wherein the elastic member is a molded body.

5. An internal combustion engine according to claim 3, wherein the elastic member is constructed as arrow-shaped deflection member for the cooling air through-flowing centrally between the cylinders.

6. An internal combustion engine according to claim 1, wherein the guide rib means extend over the largest part of the height of the cylinder means.

7. An internal combustion engine according to claim 1, wherein the guide rib means of a cylinder are disposed symmetrically to a separating rib cast-on centrally at the cylinder means and protruding radially therefrom.

8. An internal combustion engine according to claim 7, wherein adjacent guide rib means of two cylinder means disposed adjacent one another form together a substantially U-shape with a gap extending centrally between the cylinder means.

9. An internal combustion engine according to claim 8, further comprising an elastic snap-in member fastened in the gap which seals the gap over its entire length.

10. An internal combustion engine according to claim 9, wherein the elastic member is constructed as arrow-shaped deflection member for the cooling air through-flowing centrally between the cylinders.

11. An internal combustion engine according to claim 8, wherein the guide rib means extend over the largest part of the height of the cylinder means.

* * * * *